United States Patent [19]

Pickett

[11] Patent Number: 4,953,900

[45] Date of Patent: Sep. 4, 1990

[54] SINGLE USE LOCK

[76] Inventor: George F. Pickett, 3453 Beechway Blvd., Toledo, Ohio 43614

[21] Appl. No.: 520,021

[22] Filed: May 7, 1990

[51] Int. Cl.[5] ..... B65D 55/06

[52] U.S. Cl. ..... 292/307 R; 292/315; 70/20

[58] Field of Search ..... 292/307 R, 307 A, 307 B, 292/315; 70/20, 38 R, 38 A, 38 B, 38 C, 39

[56] References Cited

U.S. PATENT DOCUMENTS

| | | | |
|---|---|---|---|
| 1,424,543 | 8/1922 | Wiloch | 70/39 |
| 3,330,586 | 7/1967 | Becker | 292/315 |
| 4,342,477 | 8/1982 | McClure | 292/307 R |
| 4,505,503 | 3/1985 | LeMontagne | 292/315 |
| 4,589,693 | 5/1986 | Kennedy | 292/315 |

FOREIGN PATENT DOCUMENTS

| | | | |
|---|---|---|---|
| 340521 | 9/1921 | Fed. Rep. of Germany | 70/20 |

*Primary Examiner*—Robert L. Wolfe

*Attorney, Agent, or Firm*—Marshall & Melhorn

[57] ABSTRACT

A locking apparatus includes a generally cylindrical lock body having a pair of spaced apart radially extending lock ring apertures formed therein for accepting a lock ring and a screw aperture formed in an end of the lock body and extending to an adjacent one of the lock ring apertures for threadably accepting a lock screw. The lock ring has a curved central portion attached at opposite ends to a pair generally straight legs adapted to extend into corresponding ones of the lock ring apertures. The lock screw has a head attached to one end of a threaded body adapted to threadably engage the screw aperture and having a cutting edge formed on an opposite end for engaging one of the legs extending into the adjacent one of the lock ring apertures whereby the lock ring is retained by the lock body. The cutting edge is formed with an internal chamfer at an angle of approximately thirty degrees and an external chamfer at an angle of approximately forty-five degrees with respect to a line generally parallel to a longitudinal axis of the lock screw.

11 Claims, 1 Drawing Sheet

SINGLE USE LOCK

BACKGROUND OF THE INVENTION

The present invention relates generally to padlocks and, in particular to single use locks for locking electric utility enclosures.

In general, padlocks include a housing or body, a shackle and a locking mechanism in the housing. The shackle is inserted through the articles to be locked together, such as the links in a chain, and is engaged by the locking mechanism to maintain the shackle in the housing. Most padlocks are removable, that is the locking mechanism can be unlocked to release the shackle. The lock can be removed and used again by reactuating the locking mechanism.

However, in some instances, it is not necessary to frequently access a locked cabinet or enclosure. For example, an electric utility company has many pieces of electrical power distribution equipment located in cabinets or enclosures in remote locations. These enclosures must be securely locked to prevent unwanted tampering and damage. However, the equipment may need only infrequent maintenance. In such instances, a single use lock can be utilized. Once the lock is locked, the enclosure can only be unlocked if the single use lock is destroyed. Typically, a pair of bolt cutters is used to cut through the shackle thereby destroying any chance to reuse the lock.

SUMMARY OF THE INVENTION

The present invention concerns a single use locking apparatus for locking an enclosure whereby the enclosure can be unlocked only by destroying the locking apparatus. A generally U-shaped wire shackle or lock ring has opposite ends adapted to be retained in a pair of spaced apart apertures formed in a lock housing or body A threaded lock screw engages a threaded aperture formed in the lock body and in communication with one of the lock ring accepting apertures. In alternative embodiments, the curved portion of the lock ring can be generally V-shaped or can define more than one half circle.

In use, the lock ring is inserted through the articles to be locked together such as apertured flanges formed on a pair of cabinet doors. The ends of the lock ring legs are inserted into the apertures in the lock body and the lock screw is rotated into engagement with an outer surface of one of the legs. The threaded body of the lock screw has an end with a cutting edge formed thereon defined by inner and outer chamfers for cutting into the leg to prevent removal of the lock ring from the lock body. The head of the lock screw is attached to the threaded body by tapered portion formed with a reduced diameter such that the head breaks off at a predetermined value of torque to prevent the removal of the screw. The lock can only be removed by destroying one of the elements such as cutting through the lock ring.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
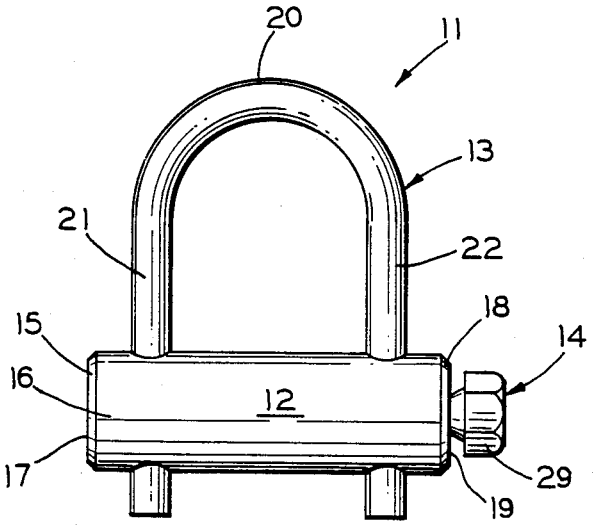
FIG. 1 is a front elevation view of a single use lock apparatus in accordance with the present invention.
Figure 2:
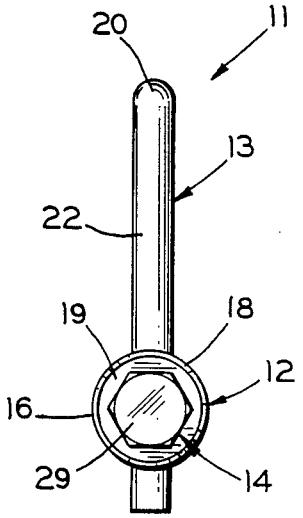
FIG. 2 is right side elevation view of the apparatus shown in FIG. 1.
Figure 3:
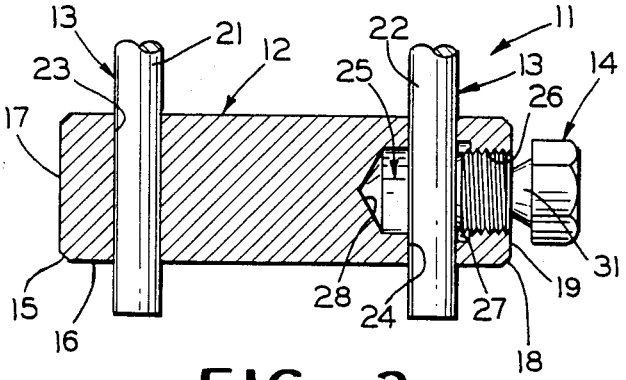
FIG. 3 is an enlarged fragmentary cross-sectional view of the apparatus shown in FIG. 1.

A single use lock 11, according to the present invention, is shown in FIGS. 1 through 3. The lock 11 includes a generally cylindrical lock body 12, a generally U. shaped lock ring 13 and a locking means or mechanism in the form of a lock screw 14. The lock body 12 has an elongated shape with a chamfer 15 formed between an outer cylindrical surface 16 and one end 17 of the body 12. A similar chamfer 18 is formed between the outer surface 16 and the other end 19 of the body 12. The chamfers 15 and 18 militate against injury to installers of the lock and to the finish of enclosures to be locked.

The lock ring 13 includes a central curved portion 20 connected between adjacent ends of a pair of generally straight legs 21 and 22. The lock ring 13 is typically formed of a generally circular cross section wire. The free ends of the legs 21 and 22 extend through a pair of apertures 23 and 24 respectively formed in the lock body 12. The apertures 23 and 24 are spaced inwardly from the ends 17 and 19 respectively and extend axially through the longitudinal axis of the body 12. The apertures 23 and 24 extend in a generally parallel direction and are spaced the same distance apart as the legs 21 and 22.

A lock screw aperture 25 is formed in the end 19 and extends into the lock body 12 along the longitudinal axis of the body. An end of the aperture 25 adjacent the end surface 19 is threaded at 26. At the inner end of the threaded portion 26, there is formed an enlarged undercut area 27 adjacent the aperture 24. The aperture 25 extends through the aperture 24 and terminates in a conical cavity 28 as is typically formed by the end of a drill tool.

Figure 4:
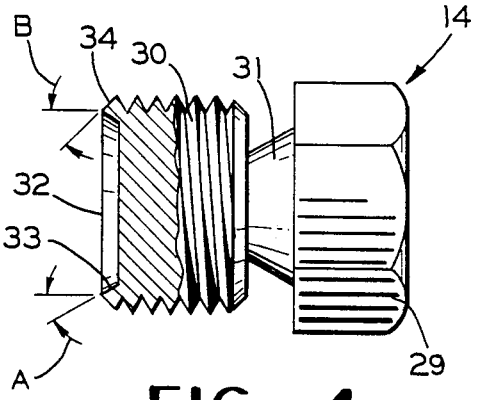
FIG. 4 is an enlarged, partial cross-sectional view of the lock screw shown in FIG. 3.

As shown in FIGS. 3 and 4, the lock screw 14 has an enlarged head 29 of a standard hexagonal shape for receiving a wrench. The head 29 is connected to one end of an externally threaded screw body 30 by a reduced diameter tapered portion 31. The portion 31 has a diameter at the head 29 smaller than the diameter of the screw body 30 and tapers to a smaller diameter at the body 30. As will be explained below, the diameter of the tapered portion 31 is selected to shear to enable the head 29 and the tapered portion 31 to break away from the screw body 30 upon the application of a predetermined torque differential between the head and the screw body.

At the end of the screw body 30 opposite the tapered portion 31 there is formed a lip or cutting edge 32. The cutting edge has an internal chamfer 33 at an angle "A" with respect to a line which is generally parallel to the longitudinal axis of the screw 14 and an external chamfer 34 formed at an angle "B" with respect to the line which is parallel to the longitudinal axis of the screw 14. It has been found that the maximum gripping force is achieved when the angle "A" is approximately thirty degrees and the angle "B" is approximately forty-five degrees.

The lock body 12, the lock ring 13 and the lock screw 14 can be formed of any suitable material. However, aluminum has been found to be satisfactory for most uses. For example, the lock body can be formed of No. 2011 T-3 C-F aluminum or No. 6061 T-6 extruded aluminum. The lock ring 13 can be formed of a No. 4 round bar wire. The lock screw 14 can be formed of No. 2011 T-3 C.F. aluminum. If the screw body 30 has a 0.290 inch diameter with a $\frac{3}{8}$-24 UNF 2A thread formed thereon, the tapered portion 31 can be formed with a 0.260 inch larger diameter and a 0.200 inch smaller diameter. When the cutting edge 32 engages the leg 22, the tapered portion 31 will shear at the smaller diameter upon the application of a predetermined torque to the head 29 preventing removal of the screw body 30 and the lock ring 13 from the lock body 12.

Figure 5:
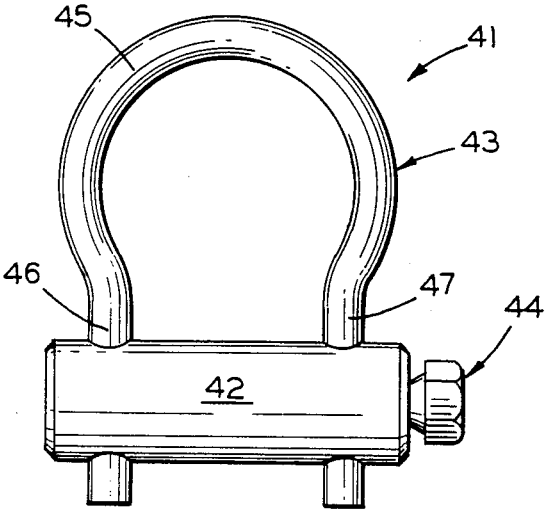
FIG. 5 is a front elevation view of a first alternate embodiment of the apparatus shown in FIG. 1.

In FIG. 5, there is shown an alternate embodiment of the present invention. A single use lock 41 includes a lock body 42, a lock ring 43 and a lock screw 44. The lock body 42 and the lock screw 44 can be the same as or similar to the lock body 12 and the lock screw 14 described above. The lock ring 43 is formed of a central portion 45 connected to ends of a pair of generally straight legs 46 and 47 which extend through apertures formed in the lock body 42. However, the central portion 45 is formed along a longer radius than the central portion 20 shown in FIG. 1. Thus, the central portion 45 defines more than one half of a circle and can be utilized in situations where the enclosure requires a larger size lock ring.

Figure 6:
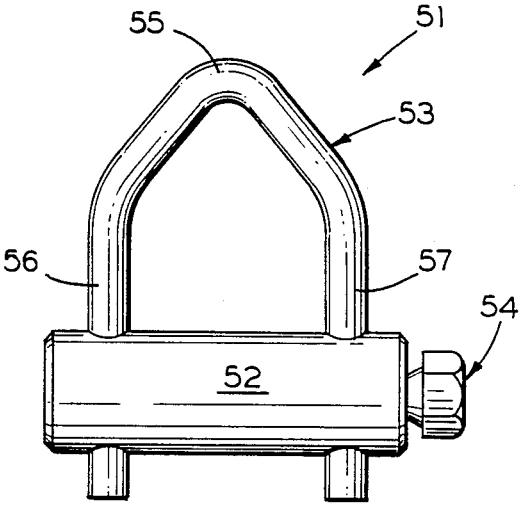
FIG. 6 is a front elevation view of a second alternate embodiment of the apparatus shown in FIG. 1.

There is shown in FIG. 6 a second alternate embodiment of the single use lock according to the present invention. A lock 51 includes a lock body 52, a lock ring 53 and a lock screw 54. The lock body 52 and the lock screw 54 are the same as or similar to the lock body 12 and the lock screw 14. The lock ring 53 includes a central portion 55 connected to ends of a pair of generally straight legs 56 and 57. The legs 56 and 57 extend through apertures formed in the lock body 52 and the leg 57 is retained by the lock screw 54. The central portion 55 of the lock ring 53 is generally V-shaped for use with enclosures where relatively little room is available for the lock.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A locking apparatus comprising:

a generally cylindrical lock body having a pair of spaced apart radially extending lock ring apertures formed therein and a screw aperture formed in an end of said lock body and extending to an adjacent one of said lock ring apertures;

a lock ring having a curved central portion attached at opposite ends to a pair generally straight legs, said legs adapted to extend into corresponding ones of said lock ring apertures; and a lock screw having a head attached to one end of a threaded body, said threaded body adapted to threadably engage said screw aperture and having a cutting edge formed on an opposite end for engaging one of said legs extending into said adjacent one of said lock ring apertures, said cutting edge being formed with an internal chamfer at an angle of approximately thirty degrees with respect to a line generally parallel to a longitudinal axis of said lock screw whereby when said legs are inserted into said apertures and said lock screw is threaded into engagement with said one leg, said lock ring is retained by said lock body.

2. The locking apparatus according to claim 1 wherein said cutting edge is formed with an external chamfer at an angle of approximately forty-five degrees with respect to a line generally parallel to a longitudinal axis of said lock screw.

3. The locking apparatus according to claim 1 wherein said lock screw is formed with a reduced diameter portion connected between said head and said threaded body.

4. The locking apparatus according to claim 3 wherein said reduced diameter portion is smaller in diameter than said threaded body.

5. The locking apparatus according to claim 3 wherein said reduced diameter portion is tapered from a larger diameter adjacent to said head to a smaller diameter adjacent to said threaded body.

6. The locking apparatus according to claim 1 wherein said central portion of said lock ring is generally U-shaped.

7. The locking apparatus according to claim 1 wherein said central portion of said lock ring defines in excess of one half of a circle.

8. The locking apparatus according to claim 1 wherein said central portion of said lock ring is generally V-shaped.

9. A single use locking apparatus comprising:

a generally cylindrical lock body having a pair of spaced apart radially extending lock ring apertures formed therein and a threaded screw aperture formed in an end of said lock body and extending into communication with an adjacent one of said lock ring apertures;

a lock having a curved central portion attached at opposite ends to a pair generally straight legs, said legs adapted to extend into corresponding ones of said lock ring apertures; and a lock screw having a head connected to a threaded body by a tapered portion, said threaded body having a cutting edge formed thereon for engaging one of said legs extending into said adjacent one of said lock ring apertures, said cutting edge being formed with an internal chamfer at an angle of approximately thirty degrees with respect to a line generally parallel to a longitudinal axis of said lock screw, said tapered portion adapted to shear upon the application of a predetermined torque differential between said head and said threaded body when said cutting edge engages said one leg.

10. The locking apparatus according to claim 9 wherein said cutting edge is formed with an external chamfer at an angle of approximately forty-five degrees with respect to a line generally parallel to a longitudinal axis of said lock screw.

11. In a single use locking apparatus including a generally cylindrical lock body having a pair of spaced apart radially extending lock ring apertures formed therein and a threaded screw aperture formed in an end of the body and extending into communication with an adjacent one of the lock ring apertures, a lock ring having a curved central portion attached at opposite ends to a pair generally straight legs, the legs adapted to extend into corresponding ones of the lock ring apertures, and a lock screw having a head connected to a threaded body, the lock screw further comprising: a cutting edge formed on an end of the threaded body for engaging one of a pair of legs on a lock ring, said cutting edge having an external chamfer at an approximately forty-five degree angle with respect to a line generally parallel to a longitudinal axis of the threaded body and an internal chamfer at an approximately thirty degree angle with respect to a line generally parallel to a longitudinal axis of the threaded body.

* * * * *